US005864881A

United States Patent [19]

Simmons

[11] Patent Number: 5,864,881

[45] Date of Patent: Feb. 2, 1999

[54] METHOD FOR TYING NECKTIES

[76] Inventor: Robert L. Simmons, 7622 Lake Adlon Dr., San Diego, Calif. 92119

[21] Appl. No.: 893,086

[22] Filed: Jul. 15, 1997

[51] Int. Cl.[6] ..... A41D 25/00; A41D 25/06; A41D 27/00

[52] U.S. Cl. ..... 2/145; 2/144; 289/1.2; 289/1.5; 289/18.1

[58] Field of Search ..... 2/52, 144, 145, 2/146, 147, 148, 149, 150, 151, 152, 152.1, 153, 154, 155, 156, 157, 338; 24/50, 55, 56, 57, 66.1; 289/1.2, 1.5, 18.1

[56] References Cited

U.S. PATENT DOCUMENTS 3,025,528 3/1962 Minter .
4,856,115 8/1989 Knapp ..... 2/155
5,088,118 2/1992 Whiteley ..... 2/144
5,109,547 5/1992 Abdallah ..... 2/145

*Primary Examiner*—Jeanette Chapman
*Attorney, Agent, or Firm*—Phanesh Koneru

[57] ABSTRACT

A method of tying neckties is presented whereby users can avoid the common frustration of repeated tying to achieve the desired lengths of the two ends of the tie to ultimately position the tie at a desired distance from neck down. The method includes tying the tie initially to the wearer's satisfaction, then marking the desired lengths, first on the wide end by removing the wide end from the knot while holding the narrow end in place against the wearer's neck, and then on the narrow end after retying by reinserting the wide end through the knot. A preferred embodiment of the invention includes markers made of commercially available flexible double-sided adhesive to hold the two ends of the tie together thereby providing the additional benefit of preventing flapping.

7 Claims, 5 Drawing Sheets

METHOD FOR TYING NECKTIES

BACKGROUND OF THE INVENTION

1. Field of the Invention

This invention relates to neckties and, more particularly, concerns a method of tying neckties that enables users to achieve a right length of the final appearance of the tie as worn around the user's neck. The method permits the user to consistently achieve a desired length of the tie during subsequent retyings regardless of the user's anatomical features, the type of knot that user employs, the degree of tightness of the knot, the type of material the tie is made of, and the length of a given tie. The invention in its preferred form includes using a commercially available flexible adhesive element such as VELCRO® to offer the additional advantage of preventing flapping or separation of the two ends of the tie by holding them together.

2. Description of the Prior Art

A well-known problem confronting the art relating to wearing an aesthetically pleasing necktie is that of acheiving a desired length of the tie. It is a common experience that it often takes repeated attempts to tie a necktie of right length. By right length it is meant here the distance one desires to have from neck down to the tip of the wide end of the tie. This desired length can vary widely from one user to another depending on anatomical characteristics such as the length of one's torso and one's neck size as well as individual taste and judgment. The length is also influenced by the type of knot one uses, such as four-in-hand, half-Windsor or Windsor knot. This problem is compounded by the availability of ties in various lengths and fabrics.

A wide range of apparent solutions to the tying problem have been developed. For example, the U.S. Pat. Nos. 5,326,004 (Daily, Jr., Jul. 5, 1994), 4,845,857 (Klosterman, Jul. 11, 1989), and 4,682,419 (Lynch, Jul. 28, 1987) describe a measuring device to determine the correct position at which to tie the user's necktie. These devices are external to the tie, are often inconvenient to use, and, more importantly, are too complicated to be of practical use. The U.S. Pat. No. 5,105,553 (Weston, Apr. 21, 1992) attempted to solve the externality problem by attaching a gauge made of a strip of fabric attached to the inside of the tie. However, this method of tying is also difficult to follow.

The U.S. Pat. No. 3,946,444 (Farrilla, Mar. 30, 1976) traches a tie having holes or openings in its wide end, through which holes the narrow end can be inserted and pulled to adjust the tie length. But this method not only destroys the fabric but also affects the aesthetic appearance of the tie. The method described in the U.S. Pat. No. 5,088,118 (Whiteley, Feb. 18, 1992) consists of marking the tie in relation to a fixed position on the wearer's anatomy or apparel. However, this method also suffers from the lack of ease in application because several tries are needed to fix the position of the marker. Another solution (the U.S. Pat. No. 4,696,064, Morwood, Sep. 29, 1987) focused on the knot formation and required a commercially uncommon design. As a result, most, if not all, of the above solutions are of limited practical use and appear to have not been commercially successful.

SUMMARY OF THE INVENTION

Accordingly, it is a primary object of this invention to provide wearer of a necktie with a quick and easy method to tie the necktie so that the tip of the wide end of the tie is positioned at the desired length from neck down.

It is a further object of this invention to provide a method of tying that consistently results in a tie of desired length that compensates for the effect of the variables such as individual anatomical and aesthetic characteristics of the wearer, the length and type of fabric of a given tie, and the type and tightness of the knot employed by the wearer.

It is a further object of the preferred form of this invention to provide a method of not only tying a tie of desired length but also preventing the two ends of a tie from flapping by using a flexible double-sided adhesive element such as commercially known VELCRO® as the marking element in the tying process disclosed and claimed herein.

In accordance with these objects, the present invention includes a simple and convenient method of tying a necktie. The method involves tying the tie initially to the wearer's satisfaction, followed by removing the wide end from the knot while holding the narrow end in place against the wearer's neck. Holding the tie around the wearer's neck in that position, the wide end should be allowed to hang freely over the front surface of the the narrow end. Immediately below the point where the tip of the narrow end touches the back surface of the wide end, a marker element should be placed on the back surface of the wide end.

With the tie in the position where the tip of the narrow end touching the top of the marker element on the back surface of the wide end, retie the tie by reinserting the wide end through the knot. This should result in a tie of desired length as originally tied. At this position, a second marker element should be placed on the front surface of the narrow end at such a distance up from the tip of the narrow end that this second marker faces the first marker on the back surface of the wide end. This completes the marking of the tie for proper positioning. To re-tie, the user, after draping the the tie around the user's neck, needs only to adjust the lengths of the two ends of the tie so that the tip of the narrow end touches the top of the first marker on the back surface of the wide end. This results in a tie of desired length. Because marking the tie does not need any measuring or further adjustments, this process results in a single-step tying that takes into account all the variables that adversely affect the desired length.

In its preferred embodiment, commercially available standard adhesive backed Velcro® is used as a marker element. When the tie is re-tied, the Velcro® markers on both the wide end and the narrow end come face to face and engage to form a clasp and thus prevent the two ends of the tie from flapping apart. However, during untying the two ends are easily releasable by pulling them apart. Thus, this preferred embodiment not only allows a tie of desired length easily, but also provides a tie that is free of flapping.

Other objects and advantages of the invention will be readily apparent from the following detailed discussion.

DETAILED DESCRIPTION OF THE PREFERRED EMBODIMENT

The present invention is a method of tying a necktie to achieve a desired length and in its preferred embodiment prevents the two ends of the necktie from flapping.

Figure 1:
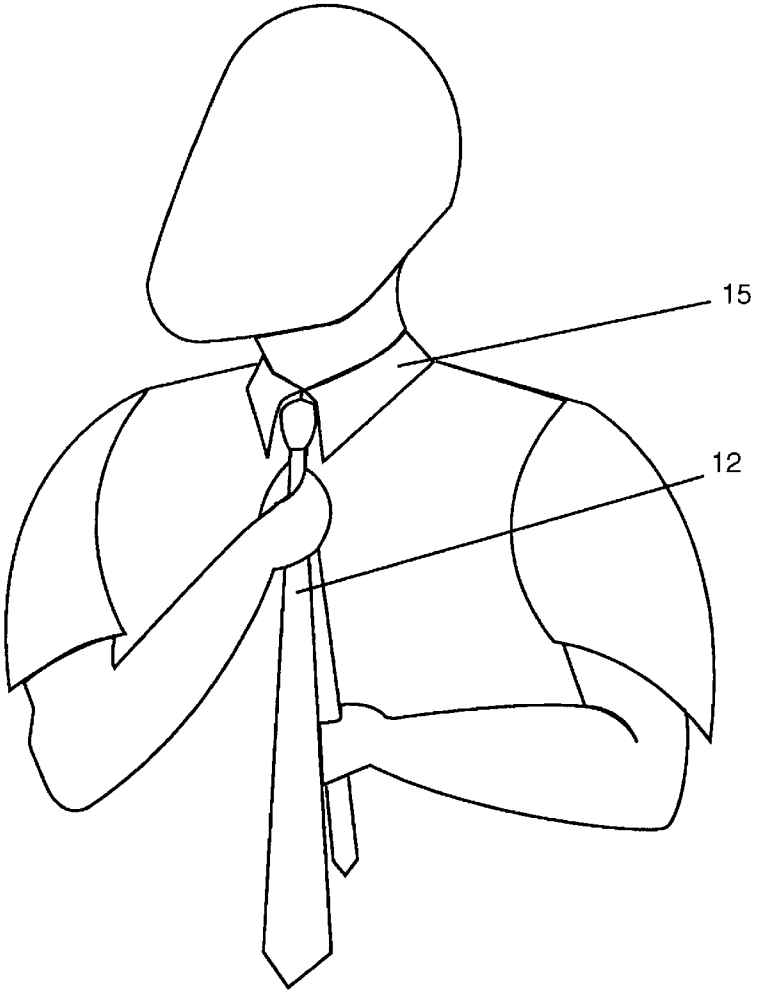
FIG. 1 is a front diagrammatic view of the necktie as tied according to the satisfaction of the wearer, representing the ideally desired length of the wide end of the tie.
Figure 2:
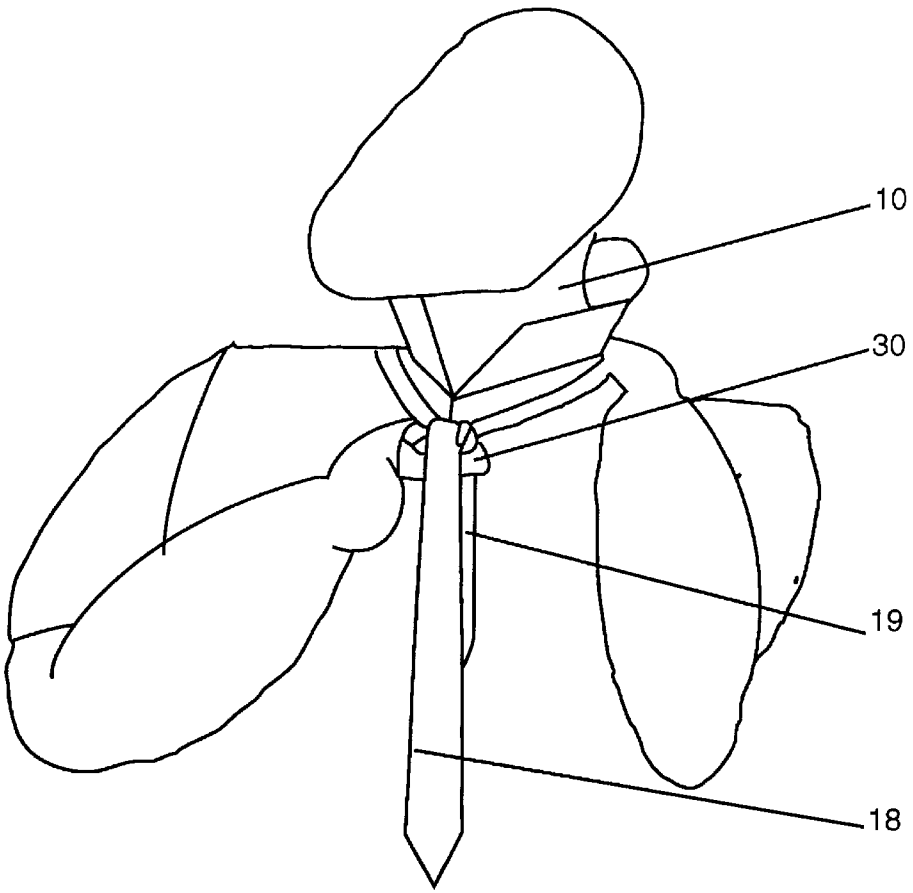
FIG. 2 is a front diagrammatic view of the neck tie with the wide end untied and positioned over the knot while the narrow end is still in place under the knot.
Figure 3:
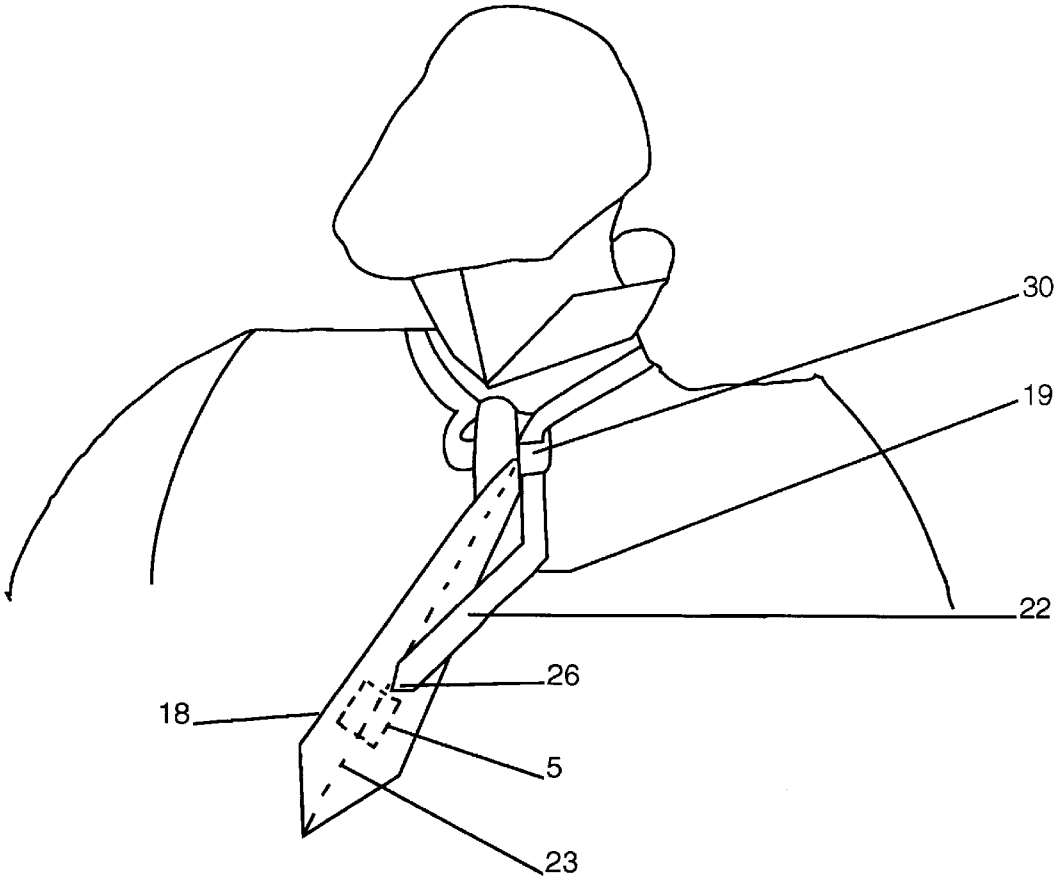
FIG. 3 is a front diagrammatic view illustrating the method of noting the position to place the first marker on the back surface of the wide end whereby a marking element should be placed immediately below the point where the tip of the narrow end touches against the back surface of the wide end.

Referring to the drawings, FIG. 1 illustrates the initial positioning of a tie (12) in an enfolded shirt collar (15), tied according to the satisfaction of the wearer. Then, as shown in FIG. 2, the wide end (18) should be removed from the knot (30), holding the narrow end (19) in place against the wearer's neck (10). While still holding the narrow end (19) in that position, the front surface (22) of the narrow end (19) should be positioned, as shown in FIG. 3, against the back surface (23) of the wide end (18). A marker (5) should be placed on the back surface (23) of the wide end (18) immediately below where the tip (26) of the narrow end (19) touches the back surface (23) of the wide end (18). With the marker (5) in place behind the wide end (18), the tie (12) should be re-tied by re-inserting the wide end (18) through the knot (30) to obtain the originally desired length of the tie (12) as shown in FIG. 1.

Figure 4:
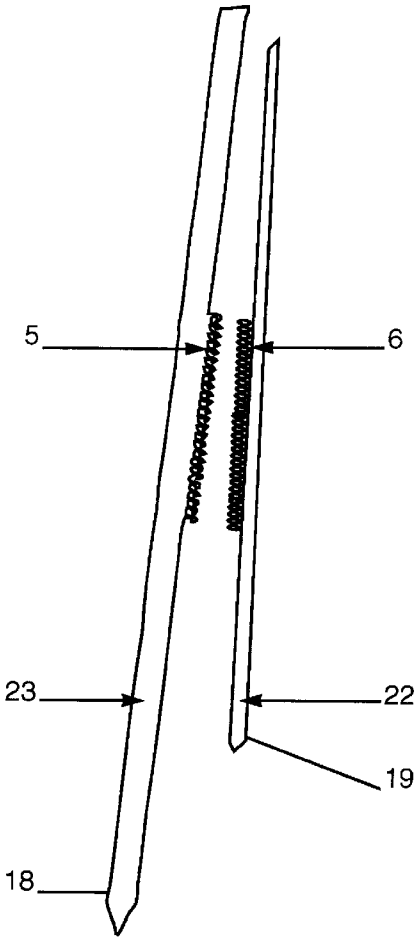
FIG. 4 is an elarged fragmentary diagrammatic view showing the positioning of the second marker element on the front surface of the narrow end in relation to the marker element on the back surface of the wide end.
Figure 5:
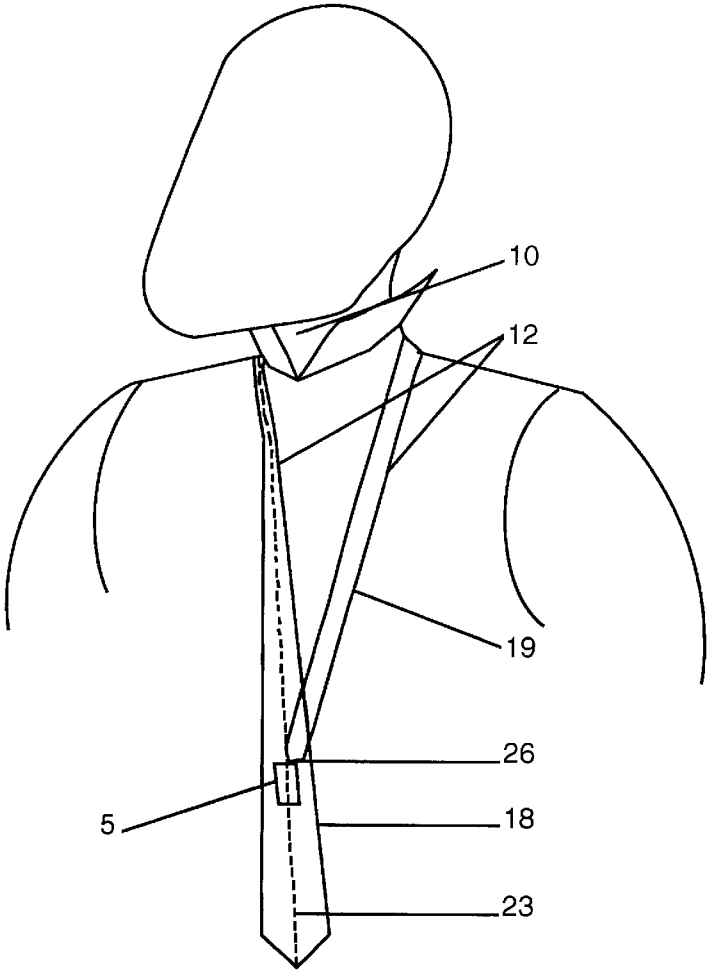
FIG. 5 is a front diagrammatic view illustrating the positioning of the premarked necktie during the process of subsequent tying whereby one drapes the necktie around the collar with two ends dangling downwardly from opposing sides of the collar and adjusts the length of the two ends by positioning the tip of the narrow end immediately above the marker element on the back surface of the wide end to result in a tie of desired length.

To complete the process of marking on the tie (12), a second marker (6) should be placed on the front surface (22) of the narrow end (19) such that, as shown in FIG. 4, the second marker (6) comes face to face with the first marker (5) on the back surface (23) of the wide end (18). The tie (12) is now strategically marked for future use. As shown in FIG. 5, to re-tie, the wearer first drapes the tie (12) around the neck (10) and then needs to adjust only the lengths of the two ends (18, 19) so that the tip (26) of the narrow end (19) touches the top of the marker (5) on the back surface (23) of the wide end (18). This results in a tie (12) of desired length as shown in FIG. 1.

In its preferred embodiment, the markers (5, 6) can be cut from standard commercially available adhesive backed Velcro® (Manufactured by . . . ) or other material with equivalent adhesive and flexibility characteristics. An example of a suitable size of the marker would be a piece of Velcro® having the dimensions of 1 inch length and ¾ inch width. Upon re-tying, the two Velcro® markers (5, 6) can be pressed into each other to form a clasp, preventing the two ends (18, 19) from flapping apart.

The present invention is a significant improvement in ease and simplicity in tying a necktie. Further, the preferred embodiment of the present invention combines the ease and simplicity of achieving the desired length with the additional advantage of preventing flapping. Because the markers (5, 6) are placed on the back surface (23) of the wide end (18) and on the front surface (22) of the narrow end (19), respectively, they are concealed from view and do not affect the overall appearance of the tie (12). A plurality of markers in different shapes and colors can be used to indicate positions for a variety of knots or to accommodate other preferences.

Although particular embodiments of the present invention are disclosed herein, it is not intended to limit the invention to such a disclosure and changes and modifications may be incorporated and embodied within the scope of the following claims. For example, while FIGS. 3, 4 and 5 show the markers in rectangular shape and as being positioned centrally on the two ends, this invention contemplates markers of different shapes and sizes and the embodiments whereby such positioning can be other than central.

What is claimed is:

1. A method of tying a necktie made of a longitudinal strip of material having a wide end and a narrow end and having a front and a back surface, for wear about the collar of a human wearer, comprising the steps of:

(a) marking said necktie with a plurality of marker elements;

(b) positioning said necktie as marked under step (a) about the collar of said wearer with said wide end and said narrow end dangling downwardly from opposing sides of the collar;

(c) adjusting said narrow and wide ends of said necktie so that a tip of said narrow end touches a top of a marking element on the back surface of said wide end; and (d) then tying said necktie in a desired knot by the user in a user's habitual manner.

2. A method of tying a necktie as recited in claim 1 wherein said marking further comprising the steps of:

tying said necktie in a desired knot and to a desired length by the user in the user's habitual manner;

untying said necktie to remove said wide end only while holding said narrow end in place against the wearer's neck;

placing the front surface of said narrow end against the back surface of said wide end;

placing one of said marking elements on the back surface of said wide end immediately below the point where the tip of said narrow end touches the back surface of said wide end;

re-tying said necktie by re-inserting said wide end through said knot; and placing another of said marking elements on the front surface of said narrow end so that said another element aligns face-to-face against said one marking element on the back surface of said wide end.

3. A method of tying a necktie according to claim 2 wherein said knot is selected from the group consisting of a four-in-hand knot, a Windsor knot, and a half-Windsor knot.

4. A method of tying a necktie according to claim 3 wherein said marking elements present a plurality of sides and include a pressure-sensitive adhesive coating on one of said sides.

5. A method of tying a necktie according to claim 4 wherein said marking elements are of a geometric shape selected from the group consisting essentially of a circle, any portion of a circle, a triangle, a quadrangle and a polygon.

6. A method of tying a necktie according to claim 5 wherein said marking elements are prepared from commercially available VELCRO®.

7. A method of tying a necktie according to claim 6 wherein each said marking element is of the dimensions 1 inch in length and ¾ inch in width.

* * * * *